US006975101B1

(12) United States Patent
Marin et al.

(10) Patent No.: US 6,975,101 B1
(45) Date of Patent: Dec. 13, 2005

(54) BAND-GAP REFERENCE CIRCUIT WITH HIGH POWER SUPPLY RIPPLE REJECTION RATIO

(75) Inventors: Nicolae Marin, Bucharest (RO); Sridhar Kotikalapoodi, Santa Clara, CA (US)

(73) Assignee: Fairchild Semiconductor Corporation, South Portland, ME (US)

( * ) Notice: Subject to any disclaimer, the term of this patent is extended or adjusted under 35 U.S.C. 154(b) by 0 days.

(21) Appl. No.: 10/718,443

(22) Filed: Nov. 19, 2003

(51) Int. Cl.[7] ..... G05F 3/16
(52) U.S. Cl. ..... 323/317; 323/316
(58) Field of Search ..... 323/317, 316, 323/315; 327/539

(56) References Cited

U.S. PATENT DOCUMENTS

| | | | | |
|---|---|---|---|---|
| 3,805,091 | A * | 4/1974 | Colin | 327/555 |
| 6,181,121 | B1 | 1/2001 | Kirkland et al. | |
| 6,188,270 | B1 | 2/2001 | Boerstler | |
| 6,198,266 | B1 * | 3/2001 | Mercer | 323/316 |
| 6,281,743 | B1 | 8/2001 | Doyle | |
| 6,294,902 | B1 | 9/2001 | Moreland | |
| 6,549,065 | B2 | 4/2003 | Opris | |
| 6,570,436 | B1 | 5/2003 | Kronmueller | |
| 6,674,275 | B2 * | 1/2004 | Darzy | 327/539 |

OTHER PUBLICATIONS

A. Paul Brokaw, "A Simple Three-Terminal IC Bandgap Reference," *IEEE Journal of Solid-State Circuits*, vol. sc-9, No. 6, (Dec. 1994), pp. 388-393.

Robert J. Widlar, "New Developments in IC Voltage Regulators," *IEEE Journal of Solid-State Circuits*, vol. sc-6, No. 1, (Feb. 1971), pp. 2-7.

* cited by examiner

*Primary Examiner*—Shawn Riley
(74) *Attorney, Agent, or Firm*—Sidley Austin Brown & Wood LLP

(57) ABSTRACT

A band-gap reference circuit includes a core reference circuit with a core output terminal, a voltage amplifier, coupled to the core output terminal and having a voltage amplifier terminal, a transconductance amplifier, coupled to the voltage amplifier terminal, and a shared voltage rail, coupled to the core reference circuit and the transconductance amplifier. The voltage amplifier and the transconductance amplifier can include multiple stages. The reference circuit can be operated at low voltages, including 1.3–1.4V. The reference circuit has low spreading within a batch of manufactured systems, partially due to the fact that the reference circuit does not utilize differential amplifiers. The reference circuit can achieve a power supply ripple rejection ratio in excess of 100 dB at low frequencies. Also, no startup circuit is required for the operation of the reference circuit.

26 Claims, 8 Drawing Sheets

BAND-GAP REFERENCE CIRCUIT WITH HIGH POWER SUPPLY RIPPLE REJECTION RATIO

BACKGROUND

1. Field of Invention

The present invention relates to band-gap reference circuits and in particular to low supply voltage, low spreading and high Power Supply Ripple Rejection Ratio band-gap reference circuits.

2. Description of Related Art

Band-gap reference circuits provide a voltage essentially independent from the operating temperature, supply voltage, and output current. The temperature dependence of transistor characteristics is detrimental to this design goal. In particular, Vbe, the base-emitter voltage of bipolar junction transistors typically has a negative temperature coefficient, or "tempco". This means that the derivative of Vbe with respect to the temperature, T is negative: dVbe/dT<0. This negative tempco can be compensated by creating an output voltage, which is the sum of Vbe and a compensating Vpt voltage:

$$Vbg=Vbe+Vpt \quad (1)$$

Here Vbe is the emitter-base voltage of the forward biased bipolar transistor junction, and Vpt is the PTAT (Proportional To Absolute Temperature) voltage. Visibly, if a Vpt is generated with a temperature coefficient, which is equal in magnitude to the negative tempco of Vbe, but opposite in sign, the sum of these two voltages becomes essentially temperature independent. Since this temperature-independence is achieved by applying voltages close to the band-gap of silicon, these circuits are often termed "band-gap" reference circuits. Correspondingly, the sum of the two voltages is denoted by Vbg.

The dependence of the band-gap reference voltage on the supply voltage is characterized by the ripple rejection ratio. The higher the ripple rejection ratio, the weaker the dependence on the supply voltage.

The dependence of the band-gap reference voltage on the load, or output current, is characterized by the load dependence, or loop gain. The higher the loop gain, the weaker the dependence on the load.

Existing designs of band-gap reference circuits either require a high supply voltage for proper operation, or if they operate at low supply voltages such as 1.3–1.4V, the ripple rejection ratio or load gain of these circuits is limited to the range of about 30 dB to 40 dB

SUMMARY

Briefly and generally, embodiments of the invention include a band-gap reference circuit with a high Power Supply Ripple Rejection Ratio.

In some embodiments a band-gap reference circuit includes a core reference circuit with a core output terminal, a voltage amplifier, coupled to the core output terminal and having a voltage amplifier terminal, a transconductance amplifier, coupled to the voltage amplifier terminal, and a shared voltage rail, coupled to the core reference circuit and the transconductance amplifier. The voltage amplifier and the transconductance amplifier can include multiple stages.

The reference circuit can be operated at low voltages, for example at 1.3–1.4V.

The reference circuit has low spreading among similarly manufactured systems. This small spreading is partially due to the fact that embodiments of the reference circuit do not utilize differential amplifiers.

The reference circuit has high power supply ripple rejection ratio. In some embodiments more than 100 dB ratios are achieved at low frequencies. Another aspect of the reference circuit is that no startup circuit is required for its operation.

BRIEF DESCRIPTION OF DRAWINGS

For a more complete understanding of the present invention and for further features and advantages, reference is now made to the following description taken in conjunction with the accompanying drawings.

DETAILED DESCRIPTION

Embodiments of the present invention and their advantages are best understood by referring to FIGS. 1–8 of the drawings. Like numerals are used for like and corresponding parts of the various drawings.

Figure 1:
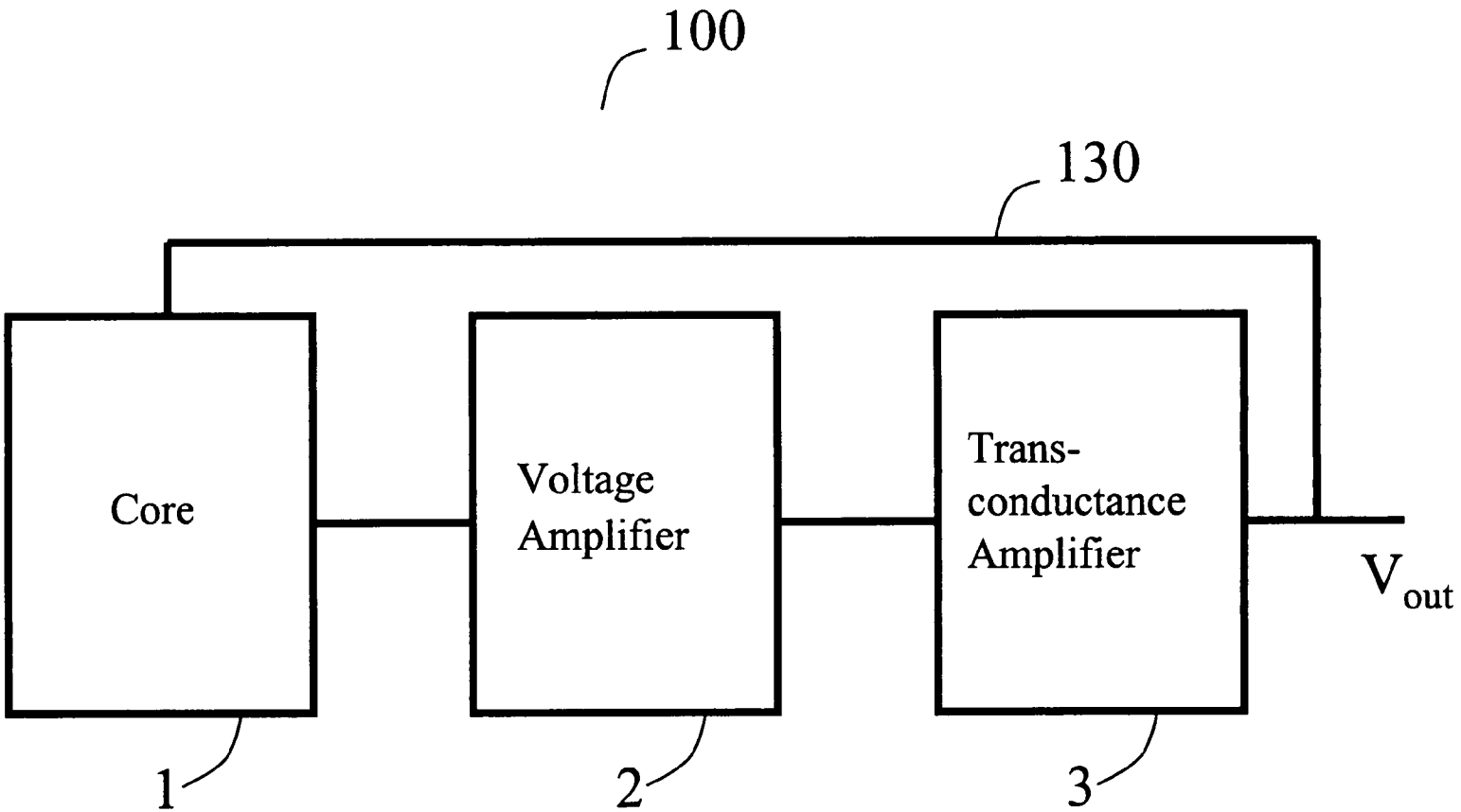
FIG. 1 is a block diagram of a band-gap reference circuit according to an embodiment of the invention.

FIG. 1 is a block diagram of a band-gap reference circuit 100 according to some embodiments of the invention. Reference circuit 100 includes a core circuit 1 coupled to a voltage amplifier 2. Voltage amplifier 2 is coupled to a transconductance amplifier 3. The output of reference circuit 100 is coupled back to core circuit 1 through a feedback loop 130.

Figure 2:
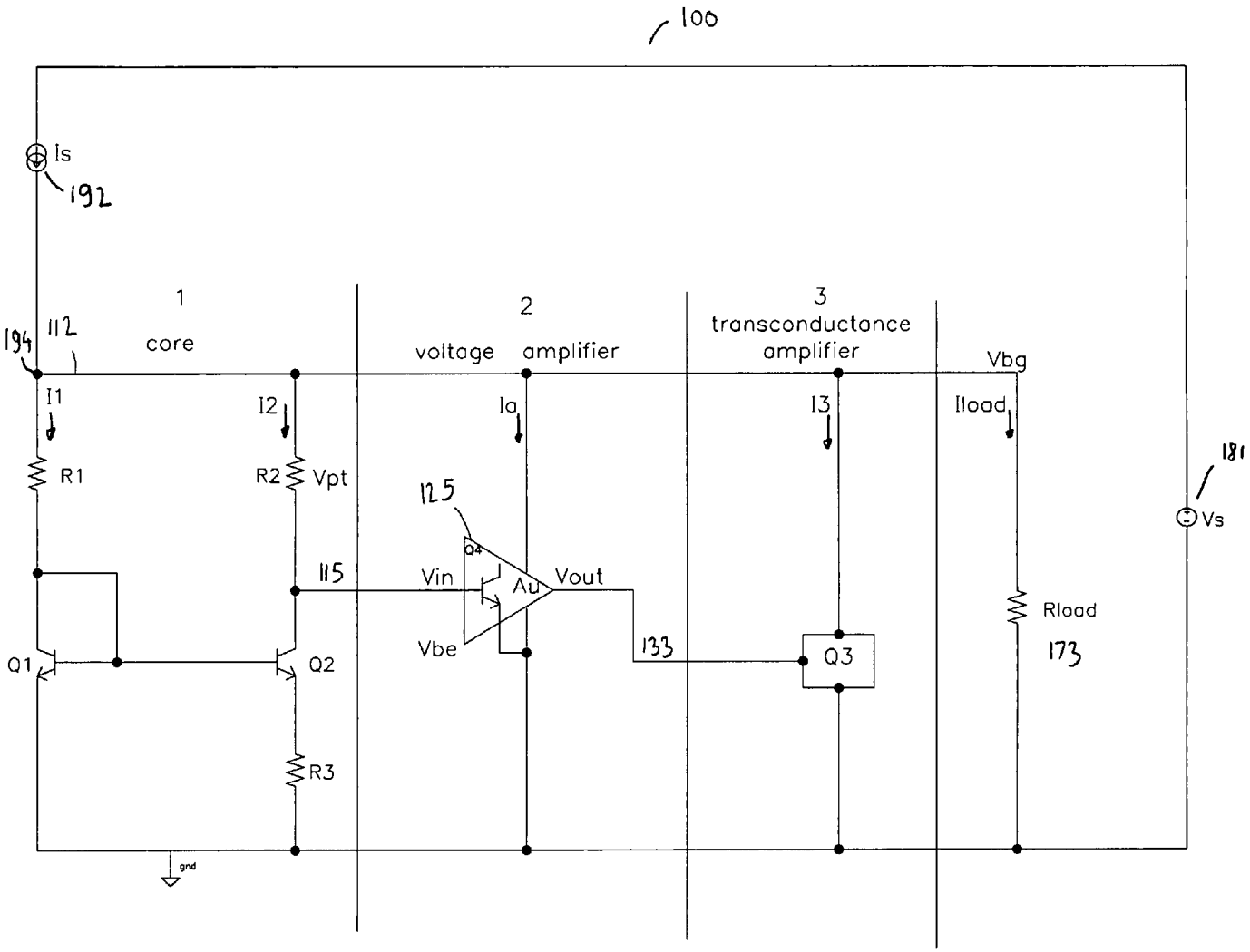
FIG. 2 illustrates a band-reference circuit according to an embodiment of the invention.
Figure 3:
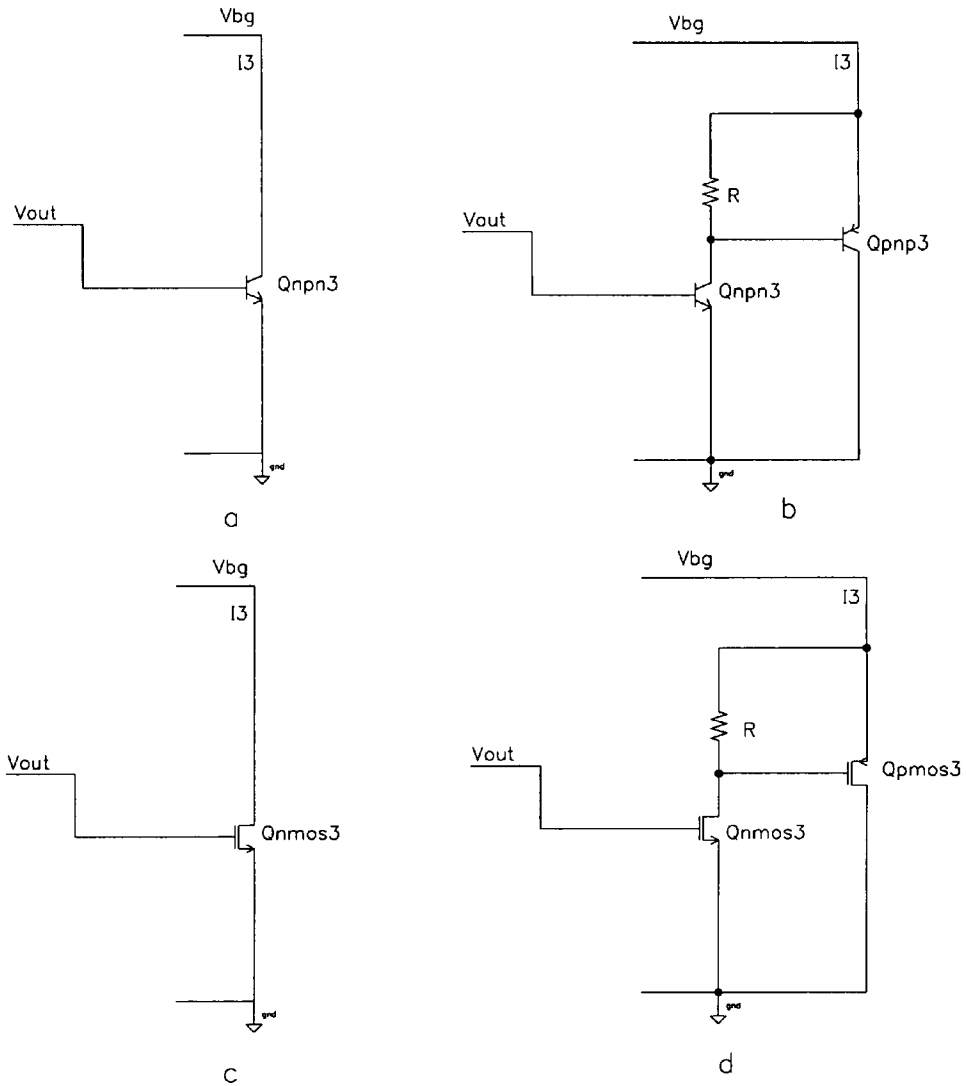
FIGS. 3A–D illustrate embodiments of a transconductance amplifier, according to embodiments of the invention.
Figure 4:
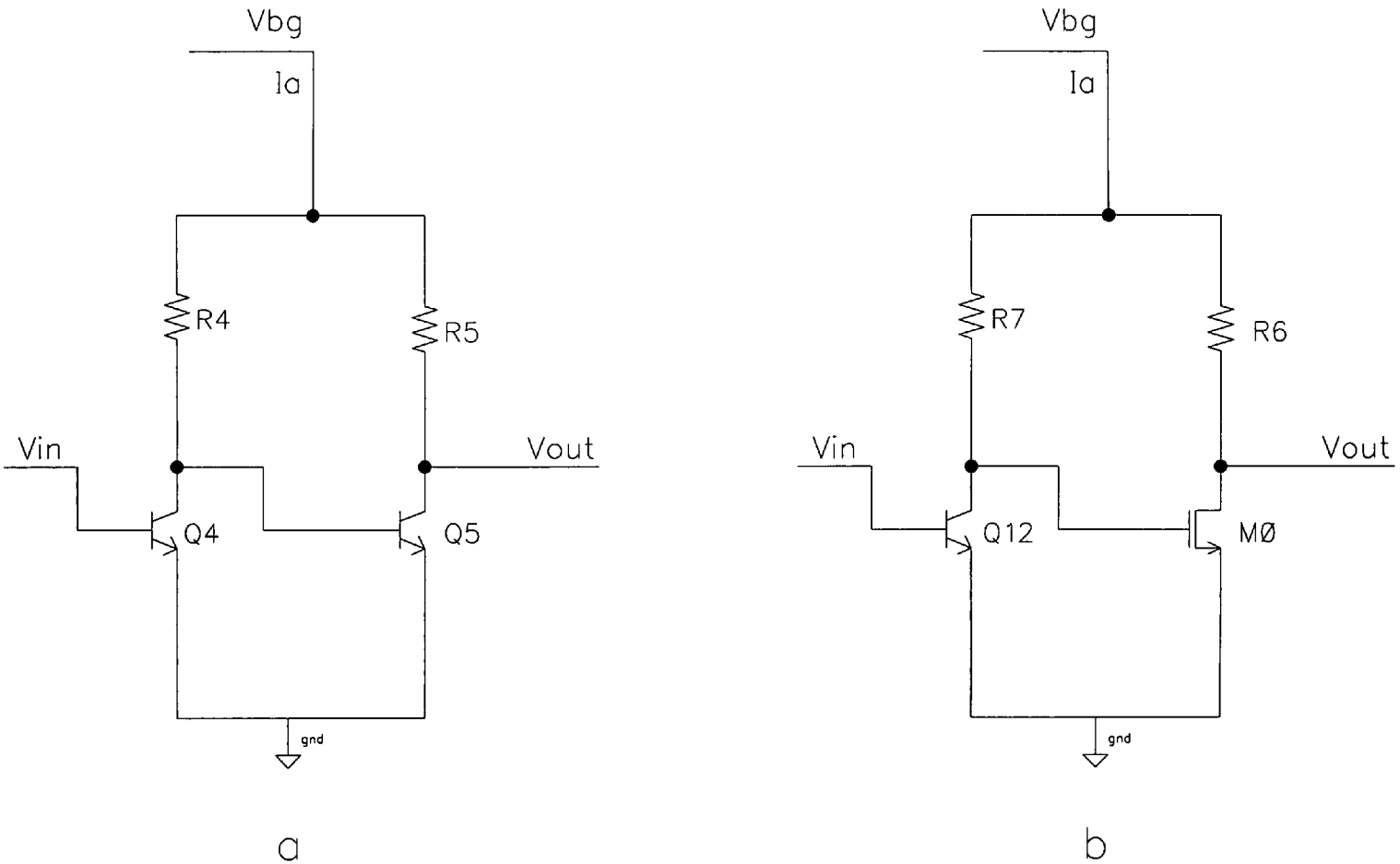
FIGS. 4A–B illustrate embodiments of a voltage amplifier, according to embodiments of the invention.

FIG. 2 illustrates an embodiment of reference circuit 100. Core circuit 1 includes a current mirror of two transistors Q1 and Q2. Reference circuit 100 will be described in terms of npn transistors. However, alternative designs utilizing pnp, CMOS, and other types of transistors are also meant to be within the scope of the invention. The emitter of transistor Q1 is coupled to the ground. The base of transistor Q1 is coupled to the base of transistor Q2. The base of transistor Q1 is also coupled to the collector of transistor Q1. The collector of transistor Q1 is coupled to voltage rail 112 through resistor R1. The voltage of voltage rail 112 is denoted by Vbg for "band gap" voltage. The collector current of transistor Q1 is denoted by I1.

The emitter of transistor Q2 is coupled to the ground through resistor R3. The base of transistor Q2 is coupled to the base of transistor Q1. The collector of transistor Q2 is coupled to voltage rail 112 through resistor R2. A core voltage terminal 115 is also coupled to the collector of transistor Q2. The collector current of transistor Q2 is denoted by I2.

One of the roles of the current mirror is to generate a positive tempco voltage Vpt. In particular, transistor Q2 produces an emitter current with a positive temperature coefficient as described below. This positive tempco current is translated into a positive tempco voltage Vpt by inserting resistor R2 into the collector circuit of transistor Q2.

In general, the temperature and current dependence of a base-emitter voltage Vbe is described by the Ebers-Moll equation:

$$Vbe=VT[ln(Ic/Is)+1], \quad (1)$$

where VT=kT/q is the "thermal voltage". Here k is Boltzmann's constant, q is the magnitude of the electron charge, Ic is the collector current, and Is is the saturation current. Using the Ebers-Moll equation in the so-called logarithmic calculus shows that the PTAT voltage Vpt across resistor R2 is given by:

$$Vpt=(R2/R3)*(kT/q)*ln(Ic2/Ic1). \quad (2)$$

Visibly, Vpt grows with the temperature, therefore, it has a positive temperature coefficient. The leading temperature dependence of the Vpt voltage is linear with possible logarithmic corrections. In some circuits the closed loop gain K=R2/R3 is controlled into the range of 4–8. In other circuits K can assume considerably higher values, up to a hundred.

In some designs transistors Q1 and Q2 are essentially identical, but the currents Ic1 and Ic2 can be different, with Ic1 typically larger than Ic2.

In other designs currents Ic1 and Ic2 are essentially equal and transistors Q1 and Q2 have different sizes. In some designs the area ratio M of Q2 relative to Q1 is between about 4 to about 100. In some embodiments the area ratio can be any value. Alternatively, transistor Q2 can be made up by a plurality of similar or essentially identical transistors coupled in parallel.

Core circuit 1 is coupled to voltage amplifier 2. Voltage amplifier 2 includes operational amplifier, or opamp 125. In some embodiments opamp 125 includes a bipolar junction transistor Q4 as an input stage. The input terminal of opamp 125, which can be the base of transistor Q4, is coupled to core voltage terminal 115. The emitter of transistor Q4 is coupled to the ground. Voltage rail 112 provides voltage for opamp 125. Opamp 125 also has a voltage amplifier terminal 133. The supply current of opamp 125 is denoted as Ia.

Voltage amplifier 2 is coupled to transconductance amplifier 3. Transconductance amplifier 3 includes transistor Q3. The base of transistor Q3 is coupled to voltage amplifier terminal 133. The emitter of transistor Q3 is coupled to the ground. The collector of transistor Q3 is coupled to voltage rail 112. The collector current of transistor Q3 is denoted by I3.

Voltage rail 112, serving as the output of band-gap reference circuit 100, is coupled to load 173, represented by resistor Rload. Therefore, the Vbg voltage of voltage rail 112 is applied across Rload, generating a current Iload across Rload.

Band-gap reference circuit 100 is driven by voltage generator 181, which generates supply voltage Vs. Voltage generator 181 drives reference circuit 100 through current generator 192. Current generator 192 is operable to limit the current, drawn from voltage generator 181.

The feedback action of feedback loop 130 is provided by coupling the band gap voltage Vbg into voltage rail 112.

Next, the operation of reference circuit 100 will be described. In core circuit 1 the base and collector of transistor Q1 are coupled together, therefore the collector voltage of transistor Q1 is equal to a diode drop. Thus, for a given Vbg the value of I1, the collector current of transistor Q1, is determined by resistor R1. The value of I2, the collector current of transistor Q2, is determined by I1, R3, and M, the area—ratio of transistors Q2 and Q1. Logarithmic calculus yields:

$$I2=(1/R3)*(kT/q)*ln(M*I1/I2). \quad (3)$$

The voltage drop across resistor R2 is the PTAT voltage Vpt:

$$Vpt=(R2/R3)*(kT/q)*ln(M*I1/I2). \quad (4)$$

Since the emitter of transistor Q4 is coupled to the ground, a Vbe voltage appears at the base of transistor Q4. Core voltage terminal 115 transfers this Vbe voltage to the collector of transistor Q2. Since Vpt is the voltage drop across resistor R2, the voltage Vbg of voltage rail 112 equals the sum of Vbe and Vpt:

$$Vbg=Vpt+Vbe$$

Vbe is proportional to the temperature with a negative temperature coefficient and Vpt is proportional to the temperature with a positive temperature coefficient. Therefore, an appropriate choice of the parameters R2, R3, and M can create a positive tempco Vpt, which is capable of fully compensating the negative tempco of Vbe, resulting in a Vbg, which is essentially temperature independent.

Embodiments of the invention do not use differential amplifiers. Differential amplifiers have offsets because of the mismatch of the parameters of their transistors, and hence increase spreading. Here "spreading" refers to the variation of the band-gap voltage of a batch of manufactured circuits.

Embodiments of the invention operate at low voltage supplies. The operating voltage supply can be in the range of about 0.6V to about 3V, for example, about 1.3V. For low supply voltages, such as 1.3V, existing operational amplifiers do not have sufficient headroom. Therefore, the gain of existing low supply voltage amplifiers is low. Typically, the ripple rejection ratio is proportional to the gain, thus, the ripple rejection ratio of existing low voltage amplifiers is also low. In some existing low voltage amplifiers the ripple rejection ratio is in the range of 30 dB–40 dB.

In contrast, embodiments of the present invention can reach ripple rejection ratios of about 100 dB, as demonstrated below.

The ripple rejection ratio is determined by the differential response of reference circuit 100 to small changes in the supply voltage. The load dependence is characterized by the differential response of the band-gap voltage to small changes in the output current. These responses will be characterized by the ratios dVbg/dVs and dVbg/dIload. The first part of the analysis does not incorporate the effect of voltage amplifier 2

If the supply voltage Vs, provided by voltage generator 181, changes by a small amount of dVs, the current Is of current source 192 changes by the corresponding small amount of dIs. The rate of this change can be expressed through Rs, the internal differential resistance of current generator Is, as:

$$Rs=dVs/dIs \quad (5)$$

Changing Is by an infinitesimal value dIs causes a dVbg change in Vbg, a dI1 change in I1, a dI2 change in I2, a dI3 change in I3, and a dIload change in Iload. To a good approximation $$dI1=dVbg/R1;dI2=0 \quad (6)$$

$$dI3=gm3*dVbg;dIload=dVbg/Rload$$

where gm3 is the transconductance of transistor Q3.

Applying Kirchhoff's first law to current node 194 yields:

$$dIs=dI1+dI2+dI3+dIload \quad (7)$$

From Equations (5), (6) and (7) the change in Vbg caused by the change in supply voltage Vs is:

$$dVbg/dVs=1/[Rs*(1/R1+1/Rload+gm3)]\sim 1/[Rs*gm3] \quad (8)$$

where the last approximation holds for systems in which gm3 is much larger than 1/R1 and 1/Rload. This ratio captures the change dVbg of the band-gap voltage Vbg in response to a change dVs in the supply voltage Vs.

Next, the change dVbg of the band gap voltage Vbg in response to a dIload change of the load current Iload will be calculated. For example, Iload can change for some external reason, in which case dIload may cease being equal to dVbg/Rload. In these situations the operating current Is of current source 192 does not change (i.e. dIs=0). Then equations (6) and (7) yield for the dVbg/dIload ratio:

$$dVbg/dIload=-1/(1/R1+gm3)\sim -1/gm3 \quad (9)$$

In summary, the differential responses of the band-gap voltage Vbg due to changes in the supply voltage Vs and load current Iload are captured by equations (8) and (9). These differential responses determine the ripple rejection ratio and load dependence of reference circuit 100. As equations (8) and (9) demonstrate, the differential responses are primarily determined by gm3, the transconductance of transconductance amplifier 3.

The higher the transconductance gm3, the smaller the changes in band-gap voltage Vbg in response to changes in the supply voltage Vs or the load current Iload.

The described embodiments of band-gap reference circuit 100 among others have the following aspects. They operate at low supply voltages, in the range of about 0.6 V to about 3V, for example about 1.3–1.4 V. The spreading of band-gap voltage Vbg from system to system is low, caused only by a mismatch of the parameters of transistors Q1 and Q2 and resistors R2 and R3. Also, band-gap reference circuit 100 has a simple layout and requires no start-up circuit.

However, the ripple rejection ratio of embodiments without a voltage amplifier is limited by the value of gm3. Typical values of the ripple rejection ratio in these embodiments are in the range of about 30 dB to 40 dB.

Next, the effect of including voltage amplifier 2 will be described. In general, these embodiments also operate at low supply voltages, have a simple layout, and preserve the low spreading of Vbg. In addition, however, they provide an improvement in the ripple rejection ratio.

The voltage gain of voltage amplifier 2 is defined as: Au=Vout/Vin. Some aspects of voltage amplifier 2 include the following. The input voltage Vin and output voltage Vout have essentially the same phase. Also, the voltage gain Au=Vout/Vin of voltage amplifier 2 is much larger than one. Further, voltage amplifier 2 is biased from the band-gap voltage Vbg or some other constant voltage source.

Finally, the input stage of voltage amplifier 2 includes npn bipolar transistor Q4, coupled to the emitter base junction of Q3. As described above, in this way the band gap voltage Vbg, which is the sum of PTAT voltage Vpt across resistor R2, and the emitter base voltage Vbe of bipolar transistor Q4, will be essentially independent of the temperature.

Voltage amplifier 2 enhances the band-gap voltage power supply ripple rejection ratio as described below.

When supply voltage Vs changes by an amount dVs, the current of current source 192 changes by dIs, given by $$Rs=dVs/dIs \quad (11)$$

Here Rs is the internal resistance of current generator Is.

The change dIs causes a change in Vbg (dVbg) and in the currents I1 (dI1), I2 (dI2), Ia (dIa), I3 (dI3), and Iload (dIload). According Kirchoff's first law as applied to node 194

$$dIs=dI1+dI2+dIa+dI3+dIload \quad (12)$$

where $$dI1=dVbg/(R1+1/gm1)=dVbg/R1 \quad (13)$$

$$dI2=1/R3*kT/q*dI1/I1=1/gm1/R3*dI1<<dI1 \quad (14)$$

and therefore $$dVbg=dVin \quad (15)$$

$$dIa<<dI3 \quad (16)$$

$$dI3=Au*gm3*dVbg \quad (17)$$

$$dIload=dVbg/Rload \quad (18)$$

From equations (11) and (18) it follows that the change in Vbg with respect to change in supply voltage Vs is:

$$dVbg=dVs/Rs/(1/R1+1/Rload+Au*gm3)=dVs/Rs/(Au*gm3) \quad (19)$$

From equation (12) with dIs=0 and equations (13)–(18) we can obtain the change in Vbg in response to a change dIload in load current Iload:

$$dVbg/dIload=-1/(1/R1+Au*gm3)=-1/(Au*gm3) \quad (20)$$

The comparison of equations (8) and (9) with equations (19) and (20) illustrates that the introduction of voltage amplifier 2 reduces the changes in the band-gap voltage due to changes in either the supply voltage or the load current by the factor of the voltage amplifier gain Au. With the Au enhancement factor, embodiments of the invention reach ripple rejection ratios in the range of about 50 dB to about 120 dB, for example about 100 dB.

FIGS. 3A–D illustrate various embodiments of transconductance amplifier 3. FIG. 3A illustrates that transconductance amplifier 3 can be a simple npn transistor with a transcoductance: gm3=dI3/dVout=gmnpn3. Here gmnpn3 is the transconductance of the bipolar npn Qnpn3 transistor.

FIG. 3B illustrates that in other embodiments transconductance amplifier 3 is a two-stage amplifier, including coupled npn and pnp transistors with a transconductance: gm3=dI3/dVout=gmnpn3×gmpnp3*(R//hiepnp3)>gmnpn3. Here gmpnp3 is the transconductance of the bipolar pnp Qpnp3 transistor, and hiepnp3 is the small signal input base resistance of transistor Qpnp3.

FIG. 3C illustrates that in other embodiments transconductance amplifier 3 can be a NMOS transistor with a transconductance: gm3=dI3/dVout=gmnmos3. Here gmnmos3 is the transconductance of the NMOS Qnmos3 transistor.

FIG. 3D illustrates that in other embodiments transconductance amplifier 3 is a two-stage amplifier, including coupled NMOS and PMOS transistors with a transconductance: gm3=dI3/dVout=gmnmos3×gmpmos3*R>gmpmos3. Here gmpmos3 is the transcodcutance of the PMOS Qpmos3 transistor.

It can be seen that the transconductance gm3 has a higher value for the two-stage embodiments of FIG. 3B and FIG. 3D.

FIGS. 4A and 4B illustrate related embodiments of voltage amplifier 2. Both are two stage amplifiers, including two transistors and two resistors.

First stage transistor Q4 is a bipolar npn transistor, which provides the Vbe voltage at terminal 115, used in generating the band-gap voltage Vbg. The second stage transistor Q5 in FIG. 4A is a bipolar npn transistor, and in FIG. 4B an NMOS transistor.

The voltage gain Au for voltage amplifier 2 is:

$$Au=A4*A5=(gm4*R4)*(gm5*R5) \quad (21)$$

Here A4 and A5 are the gains for the first stage (Q4, R4) and second stage (Q5, R5) of voltage amplifier 2.

The change dIa in amplifier current Ia in response to a change dVbg in the Vbg voltage can be calculated with the help of equations (15) and (21) as follows:

$$dIa=dI4+dI5=gm4 \quad dVbg-gm5*(gm4*R4)*dVbg=-gm5*(A4)*dVbg \quad (22)$$

Equation (22) shows that when Vbg increases, and correspondingly dVbg is positive, the amplifier current Ia decreases. This means that the voltage amplifier introduces a positive feedback for band-gap voltage Vbg.

Furthermore, using equation (17) and (22), taking into account that gm3= gm5, and that usual values for voltage gain stages are A4 greater than 10 and A5 greater than 10, it is seen that $$dI3=gm3*Au*dVbg=gm3*A4*A5*dVbg>>dIa=gm5*A4*dVbg \quad (23)$$

Equation (23) demonstrates that the negative feedback introduced by transconductance amplifier 3 is bigger than the positive feedback introduced by voltage amplifier 2. Therefore, the overall feedback for band-gap reference circuit 100 is appropriate for stable operations.

Further aspects of reference circuit 100 include that the operating voltage is low. In some embodiments the operating voltage of reference circuit 100 is about 0V to about 0.5V above the band gap voltage, for example about 0.1V –0.2 V above the band gap voltage.

Another aspect of reference circuit 100 is the small spread, or, equivalently, tight tolerance of the band-gap voltage Vbg from circuit to circuit. This small spread is partially due to the fact that embodiments of reference circuit 100 do not utilize differential amplifiers. In existing circuits the amplifier offset multiplied by the PTAT voltage resistor ratio (Voff*R2/R3) enhances the spreading of the band-gap voltage Vbg.

Another aspect of reference circuit 100 is the high power supply ripple rejection ratio. In some embodiments more than 100 dBV ratios are achieved at low frequencies.

Another aspect of reference circuit 100 a high band gap voltage load regulation.

Another aspect of reference circuit 100 that the noise is low. This aspect is related to using bipolar transistors as first stages for voltage amplifier 2 and transconductance amplifier 3 in some embodiments.

Another aspect of reference circuit 100 is that no startup circuit is required for its operation.

Another aspect of reference circuit 100 is that it requires only a small capacitance for frequency circuit compensation. For example, the relatively small compensation capacitance value of about 3–5 pF is sufficient for more than 70 degrees phase margin.

Figure 5:
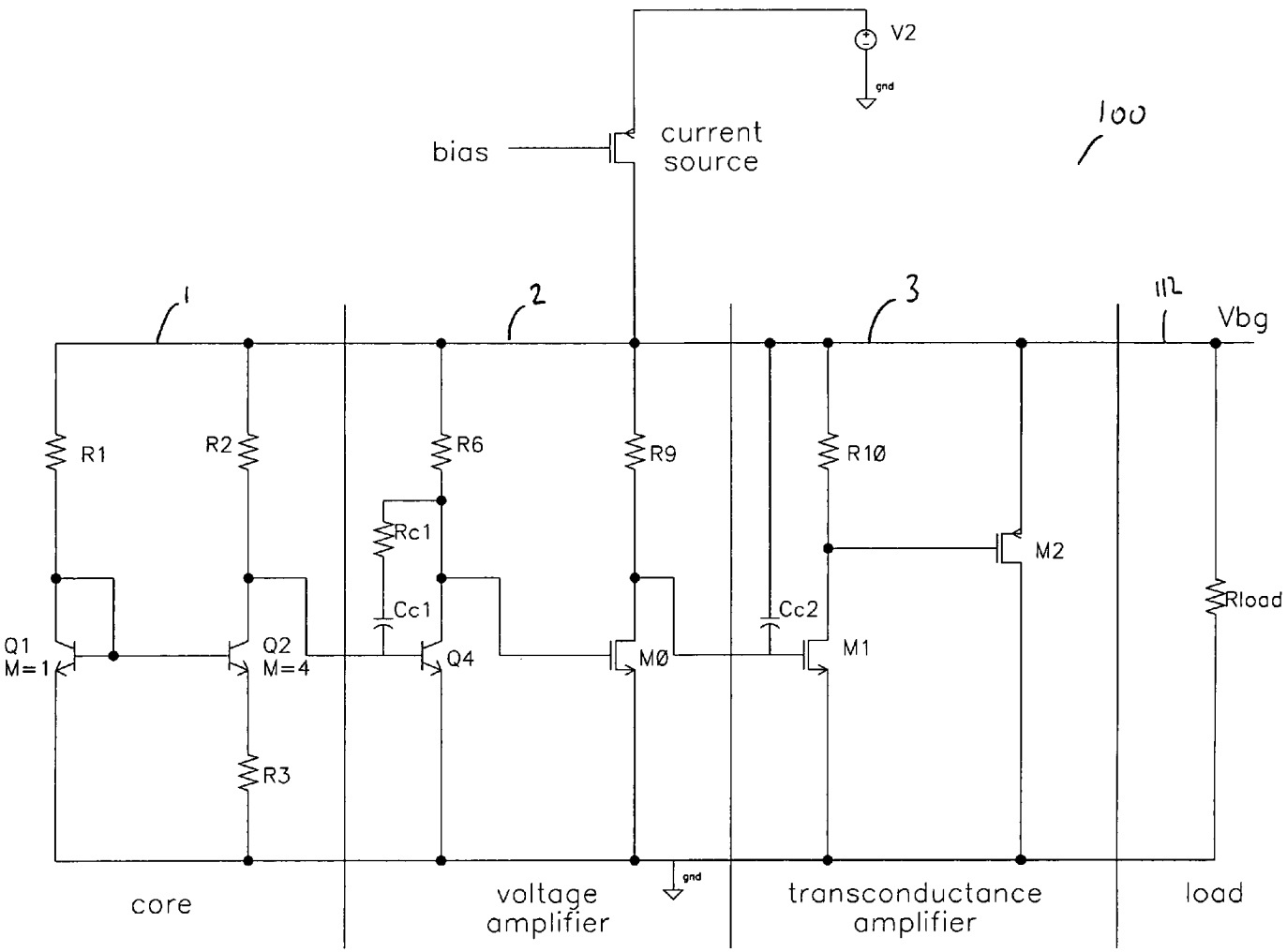
FIG. 5 illustrates a band-reference circuit according to an embodiment of the invention.

FIG. 5 illustrates another embodiment of band-gap reference circuit 100 utilizing Bipolar and BiCMOS elements. The overall topology of the circuit is analogous to that FIG. 2 and will not be described in detail.

The differences relative to FIG. 2 include that voltage amplifier 2 is a two-stage amplifier, containing first stage bipolar transistor Q4 and second stage CMOS transistor M0. Also and additional RC link, including Rc1 and Cc1, has been coupled between the collector and the base of transistor Q4.

In this embodiment transconductance amplifier 3 is also a two-stage amplifier, containing first stage CMOS transistor M1 and second stage CMOS transistor M2. Also, an additional capacitor Cc2 has been coupled between voltage rail 112 and the gate of CMOS transistor M1.

In this embodiment the input current does not reach low values. This is due to the fact that PTAT current I2 is higher than the parasitic diode current provided by the collector of transistor Q2. In some embodiments the value of parasitic diode currents at high temperatures, for example about 125 C, can be in the range of tens of nano-Amperes.

Figure 6:
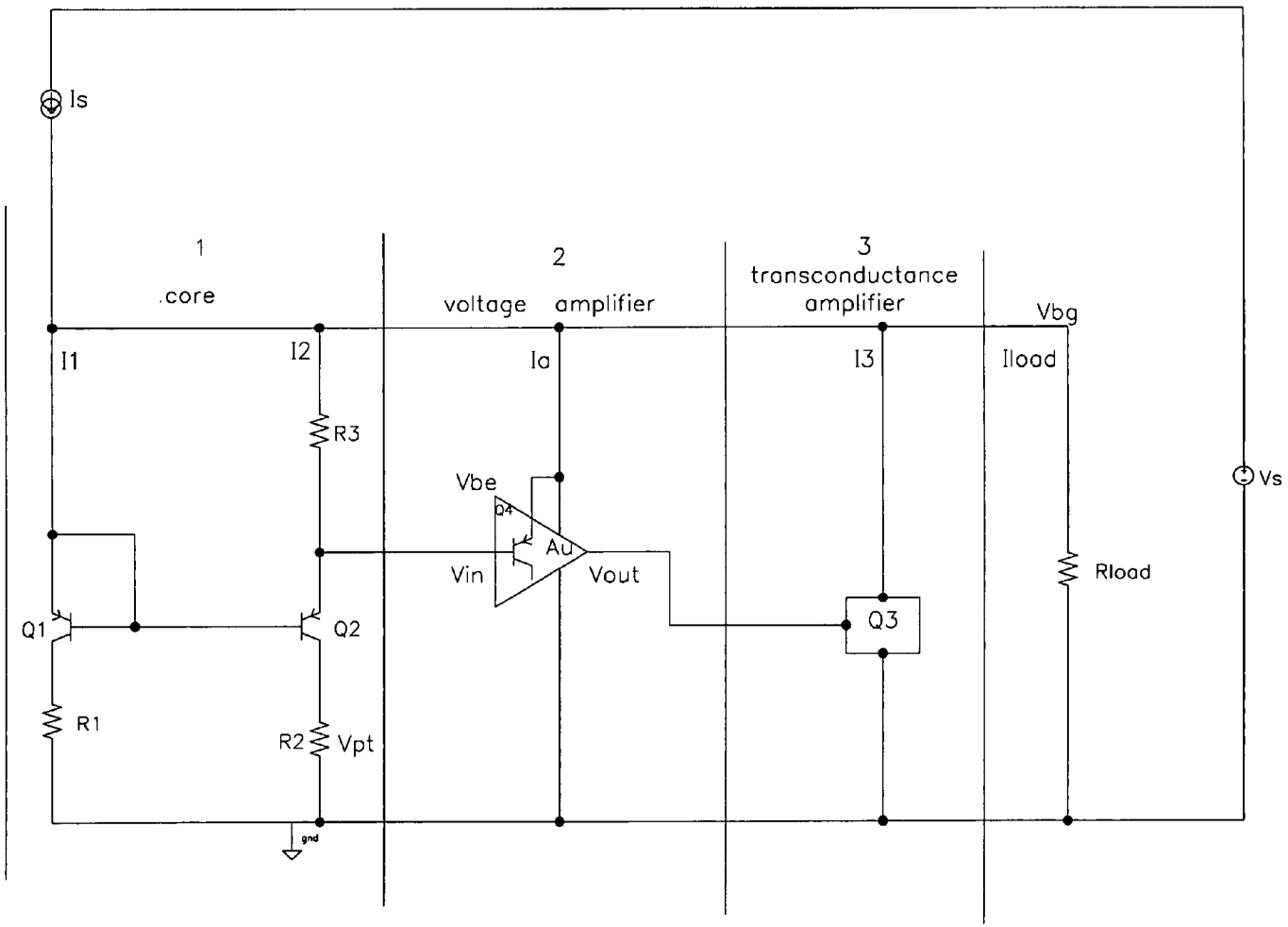
FIG. 6 illustrates a band-reference circuit according to an embodiment of the invention.
Figure 7:
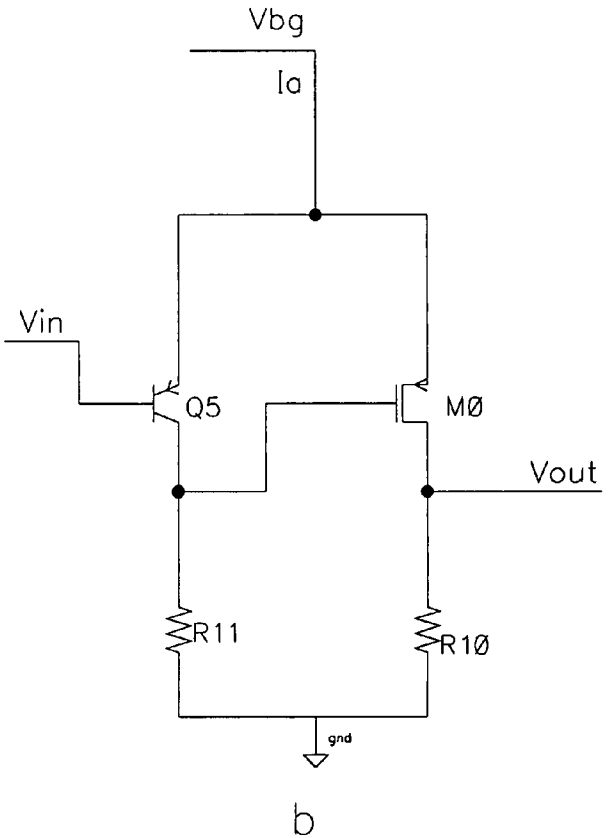
FIGS. 7A–B illustrate embodiments of a voltage amplifier, according to embodiments of the invention.
Figure 7:
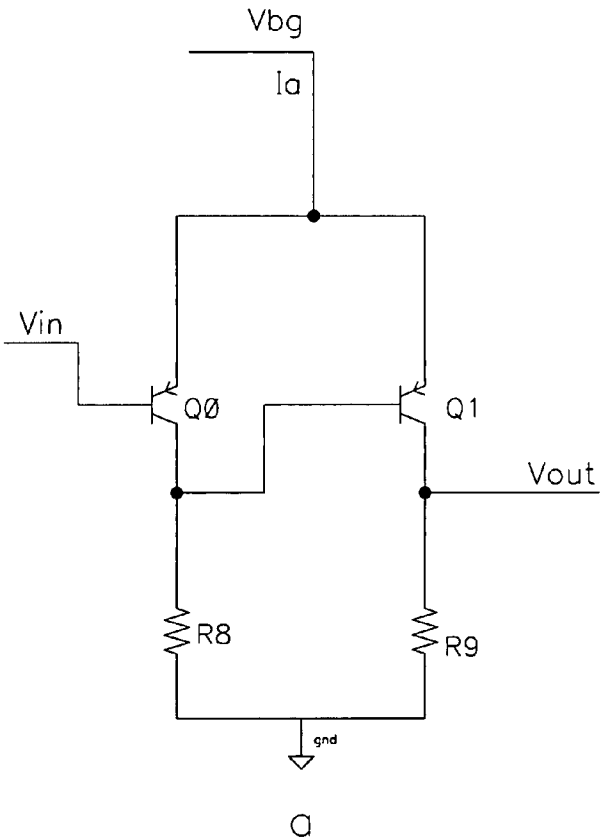
Figure 8:
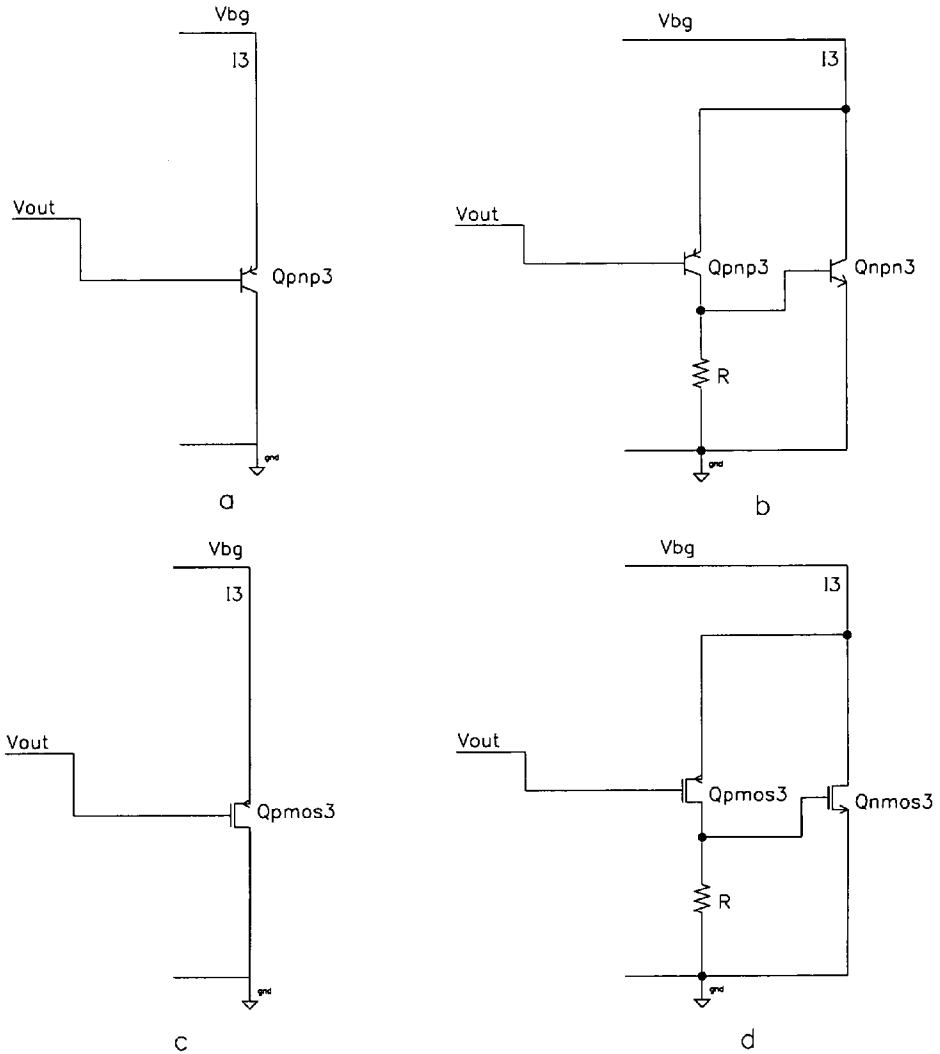
FIGS. 8A–D illustrate embodiments of a transconductance amplifier, according to embodiments of the invention.

FIG. 6 illustrates an embodiment, complementary to the embodiment of FIG. 2. In this embodiment npn (pnp) transistors are replaced by pnp (npn) transistors and nmos (pmos) transistors are replaced by pmos (nmos) transistors.

FIGS. 7A–B illustrate embodiments, complementary to the embodiments of voltage amplifier 2 in FIGS. 4A–B. In this embodiment npn (pnp) transistors are replaced by pnp (npn) transistors and nmos (pmos) transistors are replaced by pmos (nmos) transistors.

FIGS. 8A–D illustrate embodiments, complementary to the embodiments of transconductance amplifier 3 in FIGS. 3A–D. In this embodiment npn (pnp) transistors are replaced by pnp (npn) transistors and nmos (pmos) transistors are replaced by pmos (nmos) transistors.

Although the present invention and its advantages have been described in detail, it should be understood that various changes, substitutions, and alterations can be made therein without departing from the spirit and scope of the invention as defined by the appended claims. That is, the discussion included in this application is intended to serve as a basic description. It should be understood that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Neither the description nor the terminology is intended to limit the scope of the claims.

What is claimed is:

1. A band-gap reference circuit, comprising:

a core reference circuit, having a core output terminal;

a voltage amplifier, having a single ended input stage, coupled to the core output terminal and having a voltage amplifier terminal;

a transconductance amplifier, having a single ended input stage, coupled to the voltage amplifier terminal; and a shared voltage rail, coupled to the core reference circuit and the transconductance amplifier, wherein the shared voltage rail is an output voltage terminal.

2. The reference circuit of claim 1, the core reference circuit comprising:

a first transistor, having a first collector coupled to the voltage rail, a first emitter coupled to the ground, and a first base;

a second transistor, having a second collector coupled to the voltage rail, a second emitter coupled to the ground, and a second base, coupled to the first base; and a first resistor, coupled between the second collector and the voltage rail, wherein the core output terminal is coupled between the second collector and the first resistor; and said couplings are configured as one of a direct coupling and a coupling across a resistor.

3. The reference circuit of claim 2, wherein at least one of the first transistor and the second transistor comprises a plurality of transistors.

4. The reference circuit of claim 1, wherein:

the voltage amplifier comprises as input stage, comprising a third transistor, the third transistor comprising:

a third emitter coupled to the ground; and a third base, coupled to core output terminal.

5. The reference circuit of claim 4, wherein the reference circuit is operable to generate a voltage-rail voltage essentially independent of the temperature.

6. The reference circuit of claim 1, wherein the voltage amplifier comprises more than one stages.

7. The reference circuit of claim 1, wherein the transconductance amplifier comprises:

a first stage, comprising a fourth transistor, the fourth transistor comprising a fourth emitter, coupled to the ground, a fourth base, coupled to the voltage amplifier terminal, and a fourth collector, coupled to the voltage rail, wherein the coupling of the collector is one of a direct coupling and a coupling across a resistor.

8. The reference circuit of claim 1, wherein the transconductance amplifier comprises more than one stages.

9. The reference circuit of claim 1, wherein the reference circuit is powered by a voltage source and a current source, coupled in series with the voltage source, wherein the serially coupled voltage source and current source are coupled between the ground and the voltage rail.

10. The reference circuit of claim 1, comprising an output terminal coupled to the voltage rail.

11. The reference circuit of claim 1, wherein the reference circuit comprises transistors selected from the group on npn bipolar transistors, pnp bipolar transistors, NMOS, PMOS, CMOS, and BiCMOS transistors.

12. The reference circuit of claim 1, wherein the voltage amplifier and the transconductance amplifier comprise bipolar transistors as first stages, thereby keeping the noise of the reference circuit below a predetermined level.

13. The reference circuit of claim 1, operable at a supply voltage in the range of about 0.6 V to about 3V.

14. The reference circuit of claim 1, operable at a supply voltage in the range of about 1.0 V to about 1.5V.

15. The reference circuit of claim 1, operable at a supply voltage above a band gap voltage by an amount in the range of about 0V to about 0.5V.

16. The reference circuit of claim 1, operable with a ripple rejection ratio in the range of about 50 dB to about 120 dB.

17. The reference circuit of claim 1, wherein a ripple rejection ratio is essentially determined by a product of a transconductance of the transconductance amplifier and a voltage gain of the voltage amplifier.

18. The reference circuit of claim 1, wherein the transconductance amplifier introduces a negative feedback to the reference circuit and the voltage amplifier introduces a positive feedback to the reference circuit, and the magnitude of the negative feedback is bigger than the magnitude of the positive fedback.

19. The reference circuit of claim 1, wherein the reference circuit does not contain a start-up circuit.

20. The reference circuit of claim 1, wherein the reference circuit does not contain differential amplifiers.

21. The reference circuit of claim 1, wherein the spread of the reference circuit is below a predetermined value, wherein the spread comprises the spread of the parameters of similarly manufactured reference circuits.

22. The method of providing a band-gap voltage with a high ripple rejection ratio, the method comprising:

providing a core reference circuit, having a core output terminal;

providing a voltage amplifier, having a single ended input stage, coupled to the core output terminal and having a voltage amplifier terminal;

providing a transconductance amplifier, having a single ended input stage, coupled to the voltage amplifier terminal;

providing a shared voltage rail, coupled to the core reference circuit and the transconductance amplifier, wherein the shared voltage rail is an output voltage terminal; and selecting a transconductance of the transconductance amplifier and a voltage gain of the voltage amplifier so that their product generates a band-gap voltage with a ripple rejection ratio in the shared voltage rail above a predetermined value.

23. The method of claim 22, wherein the predetermined value is in the range of about 50 dB to about 120 dB.

24. The method of providing a band-gap voltage with a low supply voltage, the method comprising:

providing a core reference circuit, having a core output terminal;

providing a voltage amplifier, having a single ended input stage, coupled to the core output terminal and having a voltage amplifier terminal;

providing a transconductance amplifier, having a single ended input stage, coupled to the voltage amplifier terminal;

providing a shared voltage rail, coupled to the core reference circuit and the transconductance amplifier, wherein the shared voltage rail is an output voltage terminal; and selecting the parameters of the components of the core reference circuit, the voltage amplifier and the transconductance amplifier so that the reference circuit and the amplifiers can be operated at a supply voltage in the range of about 0.6V to about 3V.

25. The method of claim 24, wherein the minimum supply voltage is in the range of about 1.0V to about 2V.

26. The reference circuit of claim 1, wherein the voltage amplifier is coupled to the shared voltage rail.

* * * * *